US008066213B2

(12) United States Patent
Marquardsen

(10) Patent No.: US 8,066,213 B2
(45) Date of Patent: Nov. 29, 2011

(54) REPLACEABLE TOOTH MOUNT ROTOR SYSTEM FOR WASTE FRAGMENTING MACHINES

(75) Inventor: Todd J. Marquardsen, Milaca, MN (US)

(73) Assignee: Rotochopper, Inc., St. Martin, MN (US)

( * ) Notice: Subject to any disclaimer, the term of this patent is extended or adjusted under 35 U.S.C. 154(b) by 0 days.

(21) Appl. No.: 12/728,739

(22) Filed: Mar. 22, 2010

(65) Prior Publication Data

US 2011/0226880 A1 Sep. 22, 2011

(51) Int. Cl.

| | |
|---|---|
| ***B02C 1/08*** | (2006.01) |
| ***B02C 7/00*** | (2006.01) |
| ***B02C 13/00*** | (2006.01) |

(52) U.S. Cl. ..... 241/242; 241/294

(58) Field of Classification Search ..... 241/294, 241/242

See application file for complete search history.

(56) References Cited

U.S. PATENT DOCUMENTS

| | | | | |
|---|---|---|---|---|
| 6,422,495 | B1 | 7/2002 | De Boef et al. | |
| 6,880,774 | B2 * | 4/2005 | Bardos et al. | 241/189.1 |
| 7,293,729 | B2 * | 11/2007 | Ragnarsson | 241/197 |
| 2001/0045478 | A1 * | 11/2001 | Recker et al. | 241/294 |
| 2003/0116665 | A1 * | 6/2003 | Ragnarsson | 241/294 |

OTHER PUBLICATIONS

Duplex Drum, Rotor System, Vermeer, "The Vermeer Duplex Drum Rotor System", Copyright 2001, Vermeer Manufacturing Company (2 pgs.).

CBI, Magnum Force Series, Horizontal Hog, Copyright 2003-2006 Continental Biomass Industries, Inc. (see: http://www.cbi-inc.com/library/pdfs/CBI_Magnum_Force_8400P_Brochure.pdf).

* cited by examiner

*Primary Examiner* — Bena Miller

(74) *Attorney, Agent, or Firm* — Winthrop & Weinstine, P.A.

(57) ABSTRACT

Advantageously, certain embodiments of the present invention provide a system that allows easy replacement of one or more worn rotor teeth and/or rotor tooth mount(s) mounted on a waste fragmenting machine. The present invention may further provide a system that allows minimization of stress during fragmentation on the attachment mechanisms between the mount and the rotor.

16 Claims, 6 Drawing Sheets

REPLACEABLE TOOTH MOUNT ROTOR SYSTEM FOR WASTE FRAGMENTING MACHINES

BACKGROUND OF THE INVENTION

1. Field of the Invention

The invention generally relates to an improved replaceable tooth mount rotor system for material fragmenting machines.

2. Description of the Related Art

Fragmenting machines or waste recycling machines are designed to splinter and fragment wastes under tremendous impacting forces. Waste is defined herein to comprise any material that requires fragmentation prior to utilization, including, inter alia, wood, biofuel and the like. Operationally, waste materials are fed to a fragmenting zone or grinding chamber by power feeding means. Once the waste materials are within the fragmenting zone or grinding chamber, a powered fragmenting rotor that is rotating at high speed and comprising impacting and shearing teeth is encountered. The resulting impact results in the fragmentation and/or comminution of the waste materials to a desired particle size. Generally, one embodiment of a comminuting or fragmenting machine of the present invention may comprise a rotor rotating at about 1800-2500 r.p.m. Those skilled in the art will readily recognize that other r.p.m. ranges are common, e.g., between about 500 and 2500 r.p.m. The invention described herein is not meant to be limited by r.p.m. ranges and, as a result, applies to any comminuting or fragmenting machine using a powered fragmenting rotor with teeth designed to comminute material to a desired particle size. In all cases, a tremendous force is generated at the point of impact between the waste material and the impacting rotor teeth.

Wear on the rotor teeth is a concern that results in, inter alia, reductions in fragmenting efficiency and increases in costs related to maintenance and service to replace worn rotor teeth and tooth mounts. Known waste fragmenting machines may require heavy solid steel shafts and/or lock collars to hold tooth mounts and mounted teeth in position on the rotor. Such waste fragmenting machines require disassembly to replace the worn tooth mounts which is particularly labor intensive and costly. Others fail to minimize the stress experienced by the bolts used to hold the tooth mounts in place.

Tooth mounts in such systems may become chipped, warped, or gouged, resulting in rotor imbalance and/or inability to properly secure teeth. Further, tooth mounts may break as a result of an impact.

Accordingly, there remains a need for an improved mechanism for securing rotor teeth that allows for rapid and easy replacement of worn rotor teeth and tooth mounts, as well as a mechanism to minimize stresses experienced by the attachment of the mount to the rotor during fragmentation.

The present invention addresses these needs.

BRIEF SUMMARY OF THE INVENTION

Advantageously, certain embodiments of the present invention provide a system that allows easy replacement of one or more worn rotor teeth and/or rotor tooth mount(s) mounted on a waste fragmenting machine. The present invention may further provide a system that allows minimization of stress during fragmentation on the attachment mechanisms between the mount and the rotor.

The figures and the detailed description which follow more particularly exemplify these and other embodiments of the invention.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF THE INVENTION, INCLUDING THE BEST MODE

Figure 1:
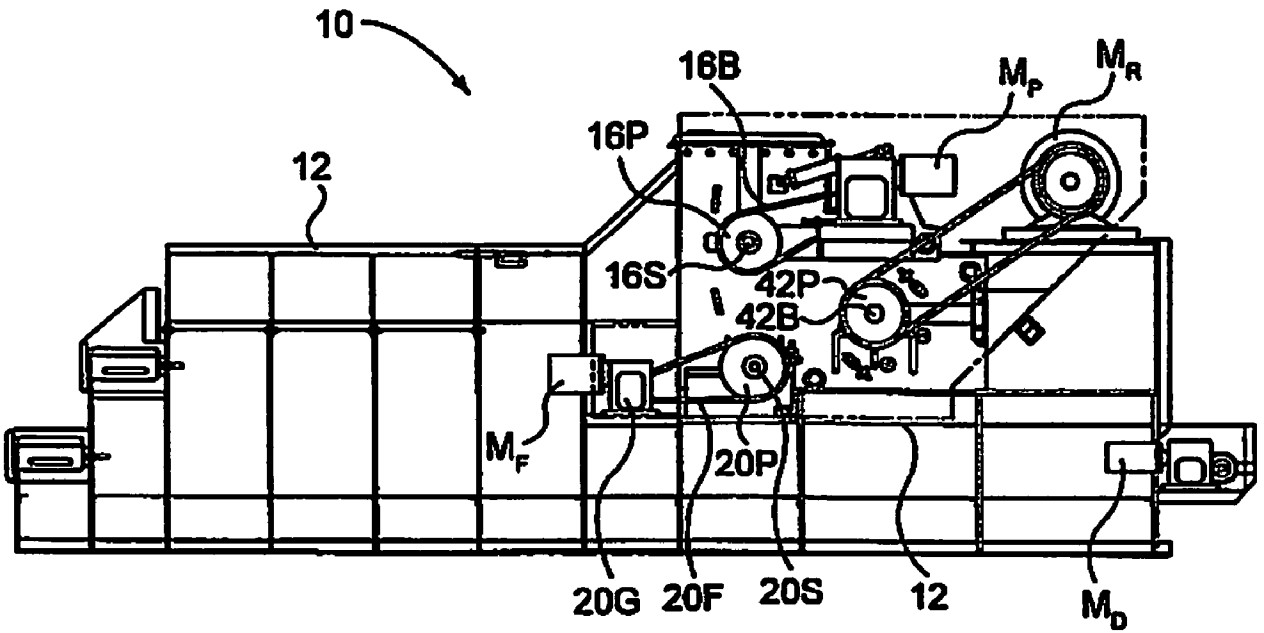
FIG. 1 is a cross-sectional view of one embodiment of a fragmenting machine of the present invention.

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

Figure 2:
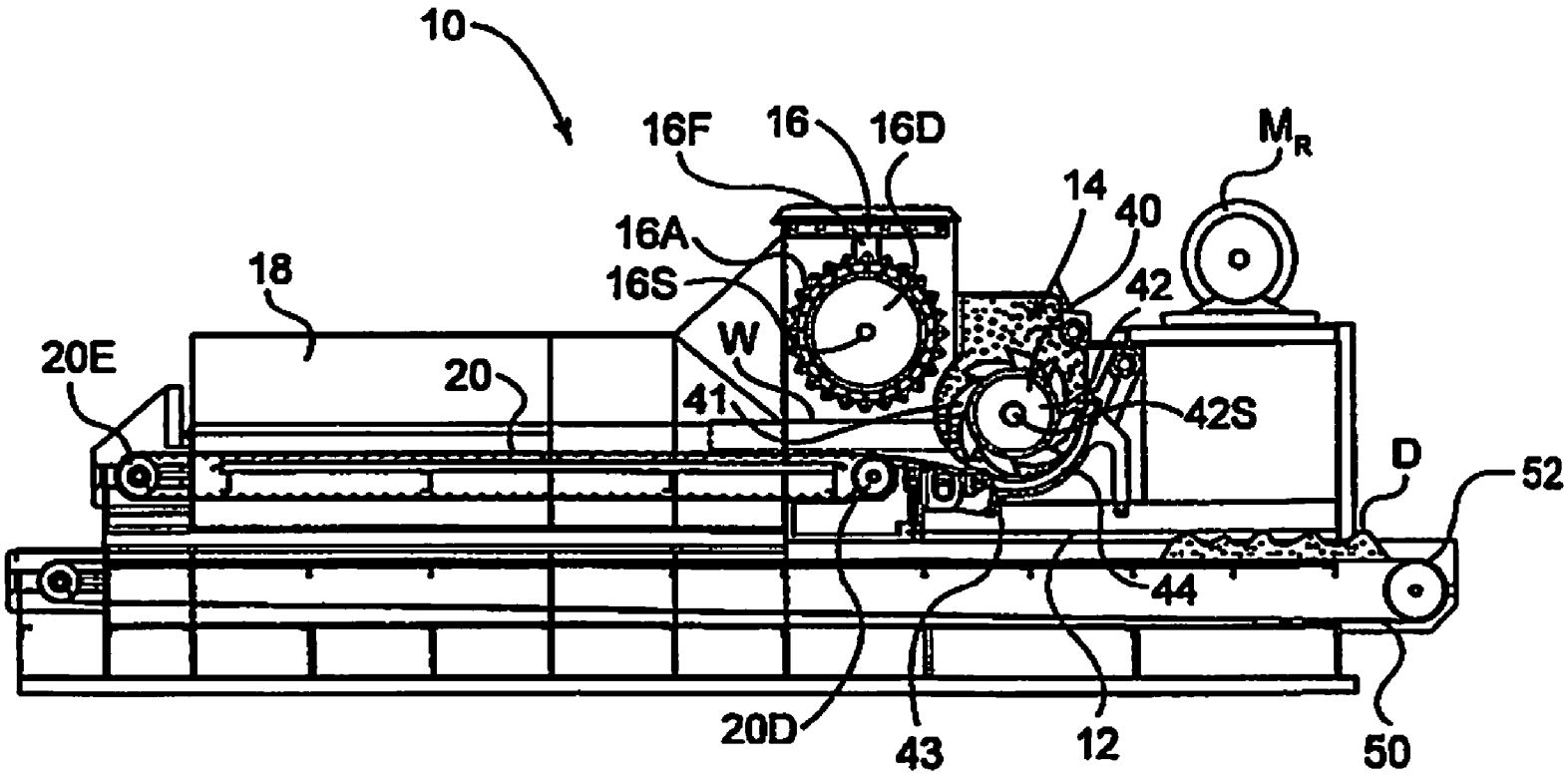
FIG. 2 is a cross-sectional view of one embodiment of a fragmenting machine of the present invention.

FIGS. 1 and 2 provide complementary cross-sectional views of one embodiment of an exemplary waste fragmenting machine 10, i.e., a horizontal grinder. The machine 10 is designed to splinter and/or fragment wastes under tremendous impacting forces. Such machine may include a frame 12 structurally sufficient to withstand the vigorous mechanical workings of machine 10. One embodiment of the machine 10 may be powered by several electrical motors generally prefixed by M, namely $M_R$, $M_D$, $M_P$, and $M_F$. These electric motors are illustrated as equipped with suitable drive means for powering the various working components, namely the feeding, fragmenting and discharging means of machine 10. It will be obvious to the skilled artisan, however, that the machine 10 may be powered by a variety of different power sources, e.g., internal combustion engines, diesel engines, hydraulic motors, industrial and tractor driven power take-off, etc.

In basic operational use in various embodiments, waste materials W may be power fed by a conveyer system to a fragmenting or grinding chamber 14 by a powered feed system 16 powered by a feed motor $M_F$ in cooperative association with a power feed rotor drum 16D powered by power feed motor $M_P$.

Thus, one embodiment of the machine 10 may include a hopper 18 for receiving waste materials W and a continuously moving infeed conveyer 20 for feeding wastes W to the waste fragmenting or grinding chamber 14. An infeed conveyer 20 may be suitably constructed of rigid apron sections hinged together and continuously driven about drive pulley 20D and an idler pulley 20E disposed at an opposing end of the conveyer 20. The conveyer 20 may be operated at an apron speed of about 10 to about 30 feet per minute, depending upon the type of waste material W. The travel rate or speed of infeed conveyer 20 may be appropriately regulated through control of gearbox 20G. Feed motor $M_F$ in cooperative association with gear box 20G, apron drive pulley 20P, chain 20F, and apron drive sprocket 20D driven about feed shaft 20S serves to drive continuous infeed conveyer 20 about feed drive pulley 20D and idler pulley 20E.

Power feed system 16 is driven by motor $M_P$ and in cooperative association with the infeed conveyer 20, driven by motor $M_F$, uniformly feeds and distributes bulk wastes W such as cellulose-based materials to the fragmenting or grinding chamber 14. Power feed system 16 positions and aligns the waste W for effective fragmentation by the fragmenting rotor 40. The power feed system 16 comprises, in one embodiment and as illustrated, a power feed wheel or rotor drum 16D equipped with projecting feeding teeth 16A positioned for counterclockwise rotational movement about power feed wheel 16D. Power feed wheel 16D may be driven by power feed shaft 16S which in turn is driven by chain 16B, drive sprocket 16P and motor $M_P$. The illustrated embodiment further comprises arm 16F which holds power feed wheel 16D in position.

A rotary motor $M_R$ serves as a power source for powering a fragmenting rotor 40 that operates within the fragmenting or grinding chamber 14. The fragmenting and grinding are accomplished, in part, by shearing or breaking teeth 41 which rotate about a cylindrical drum 42 and exert a downwardly and radially outward, pulling and shearing action upon the waste material W as it is fed onto a striking bar 43 and sheared thereupon by the teeth 41. Within some machines, the rotor may rotate upward into the feed material. The shearing teeth 41 project generally outwardly from the cylindrical drum 42, which is typically rotated at an operational speed of about 1800-2500 r.p.m, though, as discussed above, other r.p.m. ranges are well within the scope of the present invention. The fragmenting rotor 40 is driven about a power shaft 42S, which is in turn powered by a suitable power source such as motor $M_R$. Motor $M_R$ is drivingly connected to power shaft pulley 42P which drivingly rotates power shaft 42S within power shaft bearing 42B. The rotating teeth 41 thus create a turbulent flow of the fragmenting wastes W within the fragmenting chamber 14.

Initial fragmentation of the waste feed W is, in one embodiment, accomplished within the dynamics of a fragmenting or grinding chamber 14 which may comprise a striking bar 43 and a cylindrical drum 42 equipped with a dynamically balanced arrangement of the shearing or breaker teeth 41. The striking bar 43 serves as a supportive anvil for shearing waste material W fed to the fragmenting zone 4. Teeth 41 are staggered upon cylindrical drum 42 to facilitate dynamic balancing of rotor 40. Rotor 40, generally operated at an operational rotational speed of about 1800-2500 r.p.m., rotates about shaft 42S. Material fragmented by the impacting teeth 41 is then radially propelled along the curvature of the screen 44. Screen 44, in cooperation with the impacting teeth 41, serves to refine the waste W into a desired particle size until ultimately fragmented to a sufficient particle size so as to pass through screen 44 for collection and discharge by discharging conveyor 50. A discharging motor $M_D$ serves as a power source for powering a discharging means 52, illustrated as a conveyor belt and pulley system, wherein the discharging means 52 conveys processed products D from the machine 10.

The power feed system 16 helps, inter alia, maintain a consistent feed rate to the fragmenting chamber and rotor therein. Stabilization of the feed material prior to entry into the fragmenting chamber is essential to fragmentation speed and efficiency. The need for feed stability in a fragmenting machine is relative to the size and consistency of the feed material, as well as the rotor r.p.m. and torque. Thus, the power feed system 16, also referred to interchangeably in the art as a pre-crusher, power feeder, power feed drum, power feed roll or roller, or powerfeed, is an integral component of an efficient horizontal grinder.

A typical power feed wheel 16D usually comprises serrated plates, cleats or other elements, represented in FIG. 2 as power feed teeth 16A, that function to grip the feed material as it is delivered to the fragmenting chamber and rotor therein.

Maintenance of a certain downward pressure of the power feed wheel 16D on the feed material will help regulate the speed with which the material enters the fragmenting chamber and encounters the rotor. This downward pressure assists, inter alia, in preventing the fragmenting rotor 40 from pulling the feed material in too quickly. The downward pressure of the power feed wheel 16D stabilizes the feed material by providing a level of compression and lateral movement of the feed material prior to encountering the rotor, thus improving the efficacy of fragmentation within the fragmenting chamber 14. The skilled artisan will recognize that the power feed device described is not a required element, but is preferred.

Figure 3:
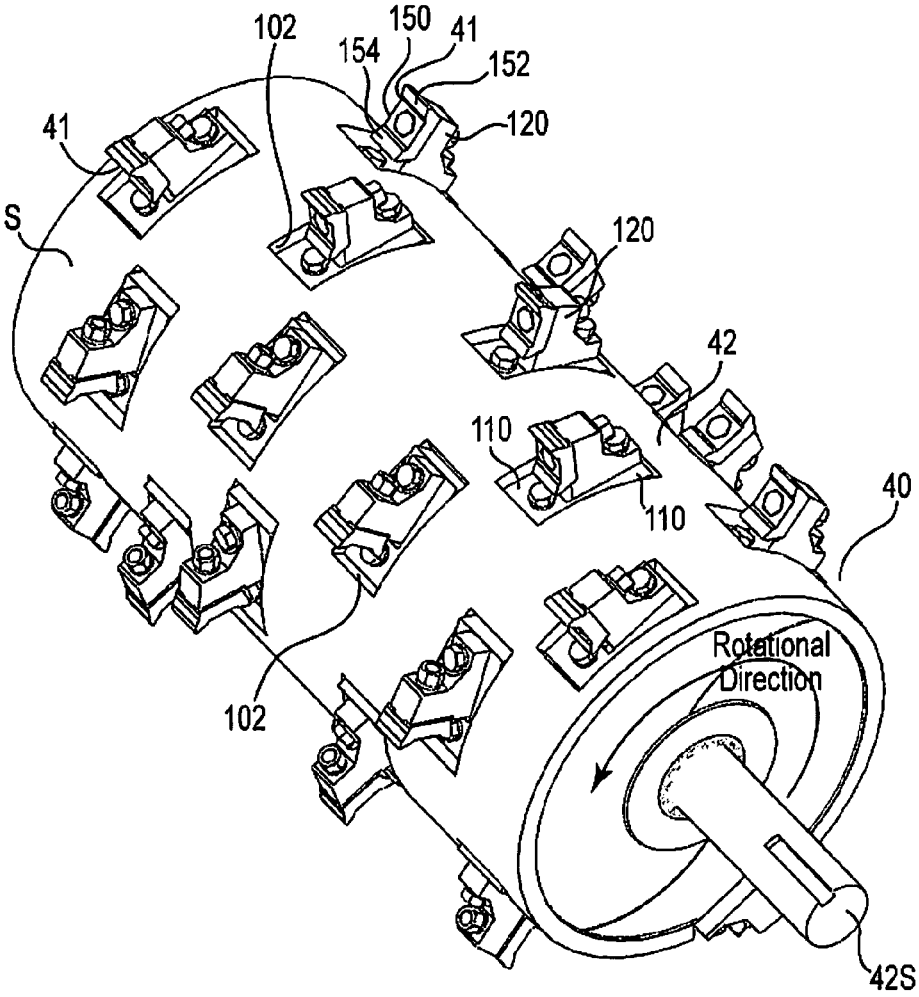
FIG. 3 is a broken away perspective view of one embodiment of rotor of the present invention.

FIGS. 3-6 illustrate one embodiment of the inventive system 100. FIG. 3 provides a perspective view of the fragmenting rotor 40 with a plurality of teeth 41 mounted in a spaced apart exemplary configuration upon cylindrical drum 42 to facilitate dynamic balancing of rotor 40 and to provide full coverage during fragmenting rotation of rotor 40. The skilled artisan will recognize that many variants of tooth 41 positioning and spacing upon cylindrical drum 42 are possible, each such variant is within the scope of the present invention. Rotational direction of the illustrated embodiment is shown by the arrow in FIG. 3.

A system 100 of the present invention comprises, inter alia: a plurality of spaced apart cutouts 102 defined by the outer surface S of cylindrical drum 42; a holder 110 attached within each cutout 102; a mount 120 attached to each holder 110; and a tooth 41 attached to each mount 120.

Cylindrical drum 42 comprises an outer surface S with a plurality of spaced apart cutouts 102 defined thereon and therethrough, each cutout 102 marking the future position of a tooth 41 on cylindrical drum 42 when mounted thereon. Within each cutout 102, a holder 110 is fixed by known methods, e.g., and without limitation, welding. The holder 110 comprises an upper surface 111, a lower surface 112 and a central mount aperture 113 therethrough. Holder 110 further comprises a leading mounting bolt aperture 114 therethrough and a trailing mounting bolt aperture 116 therethrough. As illustrated, the cutouts 102 and holders 110 are rectangular in shape. It will be obvious to those skilled in the art that a rectangular shape is not necessary and that other shapes will serve the objectives of the present invention, each such shape being within the scope of the present invention.

Figure 4:
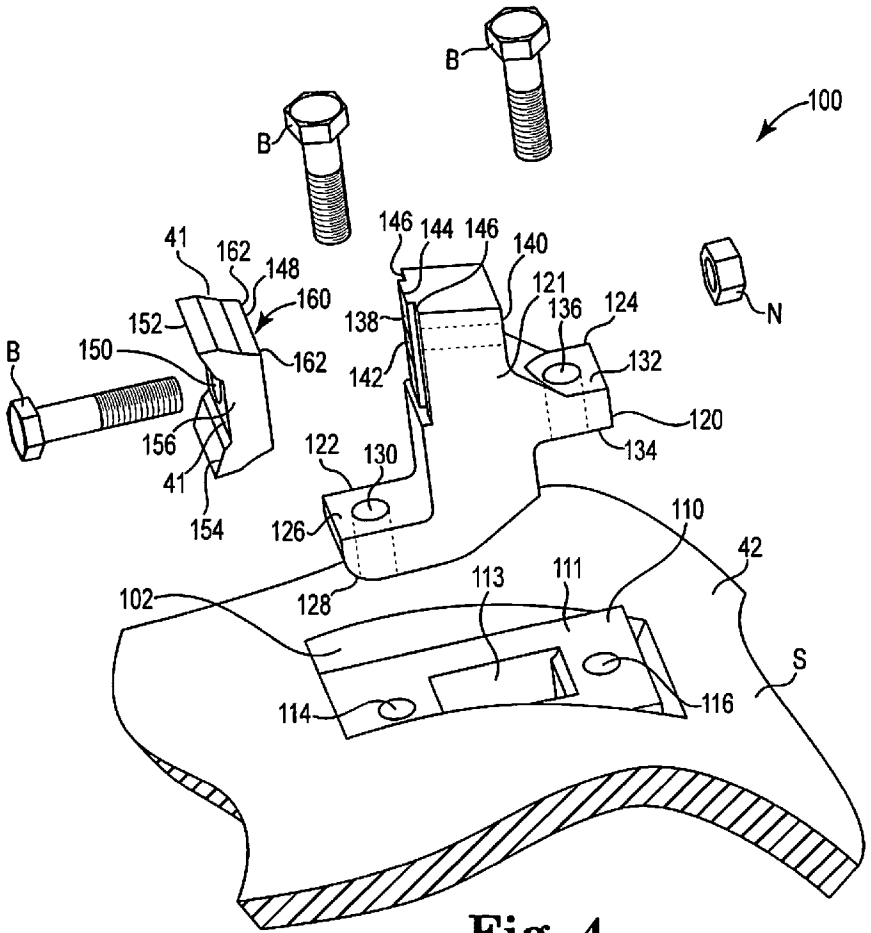
FIG. 4 is an exploded view of one embodiment of the present invention.

As best illustrated in the exploded view of FIG. 4, mount 120 may engage and attach to holder 110. Mount comprises a central body 121, the central body comprising a lower arm 122 and an upper arm 124. The lower arm 122 comprises an upper surface 126 and a lower surface 128, with an aperture 130 therethrough. Upper surface 126 may be flat as illustrated. The upper arm 124 comprises an upper surface 132 and a lower flat surface 134, with an aperture 136 therethrough. The central body 121 further comprises a leading surface 138 and a trailing surface 140, with an aperture 142 therethrough. As shown, leading surface 138 comprises a vertically central raised section 144 with flat step sections 146 on each side of the vertically central raised section 144. This arrangement may be used as a key to ensure proper alignment of a tooth having complementary surfaces for attachment thereto. Such alignment geometry will be discussed further supra.

A unique feature of the present invention is the attachment arrangement of holder 110 to mount 120. As illustrated, the mount 120 engages the central aperture 113 of holder 110. To accomplish this engagement, the mount 120 is rotated forward and the lower arm 122 is moved through central aperture 113 of holder 110. The upper surface of lower arm 122 is then engaged with the lower surface 112 of holder 110. At the same time, the lower surface 134 of the upper arm 124 of mount 120 engages the upper surface 111 of holder 110. This arrangement simultaneously brings apertures 114 and 130 into alignment on the leading edge of the system and apertures 116 and 136 into alignment on the trailing edge of the system. A bolt B may then be moved through aligned apertures 114 and 130, tighteningly engaging and attaching the upper surface 126 of lower arm 122 of mount 120 against lower surface 112 of holder 110 on the leading edge of the system 100. Similarly, a bolt B may be moved through aligned apertures 116 and 136, tighteningly engaging and attaching the lower surface 134 of upper arm 134 of mount 120 against the upper surface 111 of holder 110 on the trailing edge of the system 100. When mount 120 is engaged in this manner with holder 110, mount 120 cannot move in the direction opposite that of the rotational direction (indicated by arrow, e.g., in FIG. 3), such movement being restricted by the structural engagement of mount 120 with holder 110. The unique benefits of this arrangement will be discussed further supra.

Each tooth 41 is attached to the leading surface 138 of a mount 120. Exemplary tooth 41 comprises a body having a generally flat leading middle surface 150 with an upper angled grinding surface 152 adjacent the middle surface 150 and a lower angled grinding surface 154 adjacent the middle surface 150, with the leading middle surface 150 therebetween as illustrated and a back surface 148 having a geometry. The flat leading middle surface 150 of each tooth 41 comprises an aperture 156 therethrough which is aligned with mount 120 aperture 142 when properly positioned for attachment to the mount 120.

As described above, leading surface of the mount 138 may comprise a geometry that is complementary to the raised central section 144 with adjacent side stepped sections 146. Each tooth 41 may comprise complementary structure on its back surface 148. Thus, the back surface 148 of the illustrated embodiment of tooth 41 comprises a central groove 160 disposed vertically along the back surface 148, with adjacent side surfaces 162. This central groove 160 may engage and receive the complementary raised central section 144 of the mount 120, and the adjacent side surfaces 162 may engage the respective and complementary adjacent side stepped sections 146 of the illustrated embodiment of mount 120, thus ensuring proper alignment and assisting in keeping the tooth 41 in proper position during fragmenting. As illustrated, a bolt is threaded through aligned apertures 156 and 142, tightened against the trailing surface 140 of mount 120 with nut N to attach tooth 41 to mount 120. With some tooth styles, the tooth 41 may be threaded to accept a bolt inserted from the back of the mount 120. In general, as the skilled artisan will readily recognize, the present invention is not so limited as to the particular embodiment of tooth 41 and mount 120 illustrated, specifically as to the mating configuration between the tooth 41 and mount 120 since an advantage of the present invention is the ability to change the rotor mounts to allow for the use of rotor teeth with different mating configurations. In addition, some rotor teeth may require a single mounting bolt. Other teeth may require two mounting bolts. Some teeth have slotted mating surfaces while others may have flat mating surfaces as is well known to the skilled artisan. Each of these known tooth mounting configurations requires the mount 120 comprise a complementary mating surface to mate with the tooth 41 and/or mounting apertures to accommodate the required number of bolt(s) to secure the tooth 41. What is required is that the back surface 148 of the tooth 41 and the leading surface 138 of the mount 120 comprise geometries that are complementary. Each such embodiment is within the scope of the present invention; thereby allowing interchangeability of the tooth mount(s) when necessary to accommodate teeth with different mating configurations.

Figure 5:
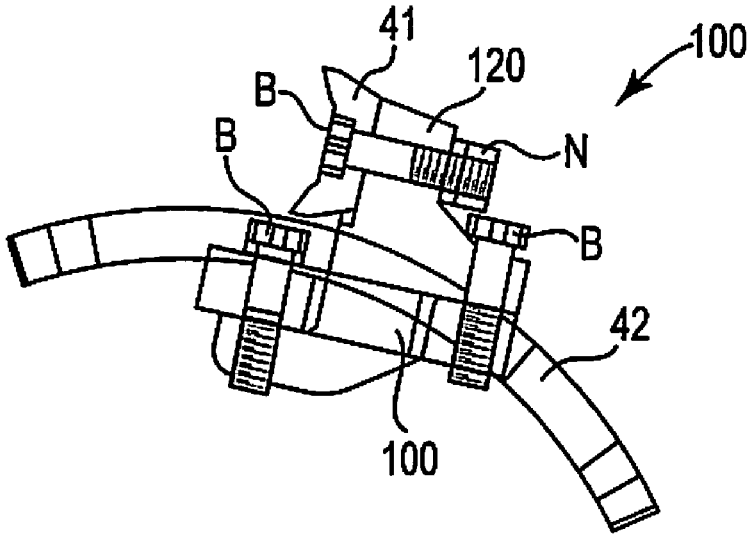
FIG. 5 is a broken away cross-sectional view of one embodiment of the present invention.

Thus, the system 100 comprises a total of three securing bolts B: first and second bolts B securing and attaching the mount 120 to the holder 110 and a third bolt B, together with nut N, securing and attaching the tooth 41 to the mount 120. FIG. 5 best illustrates the relative positioning of the elements of system 100.

Figure 6:
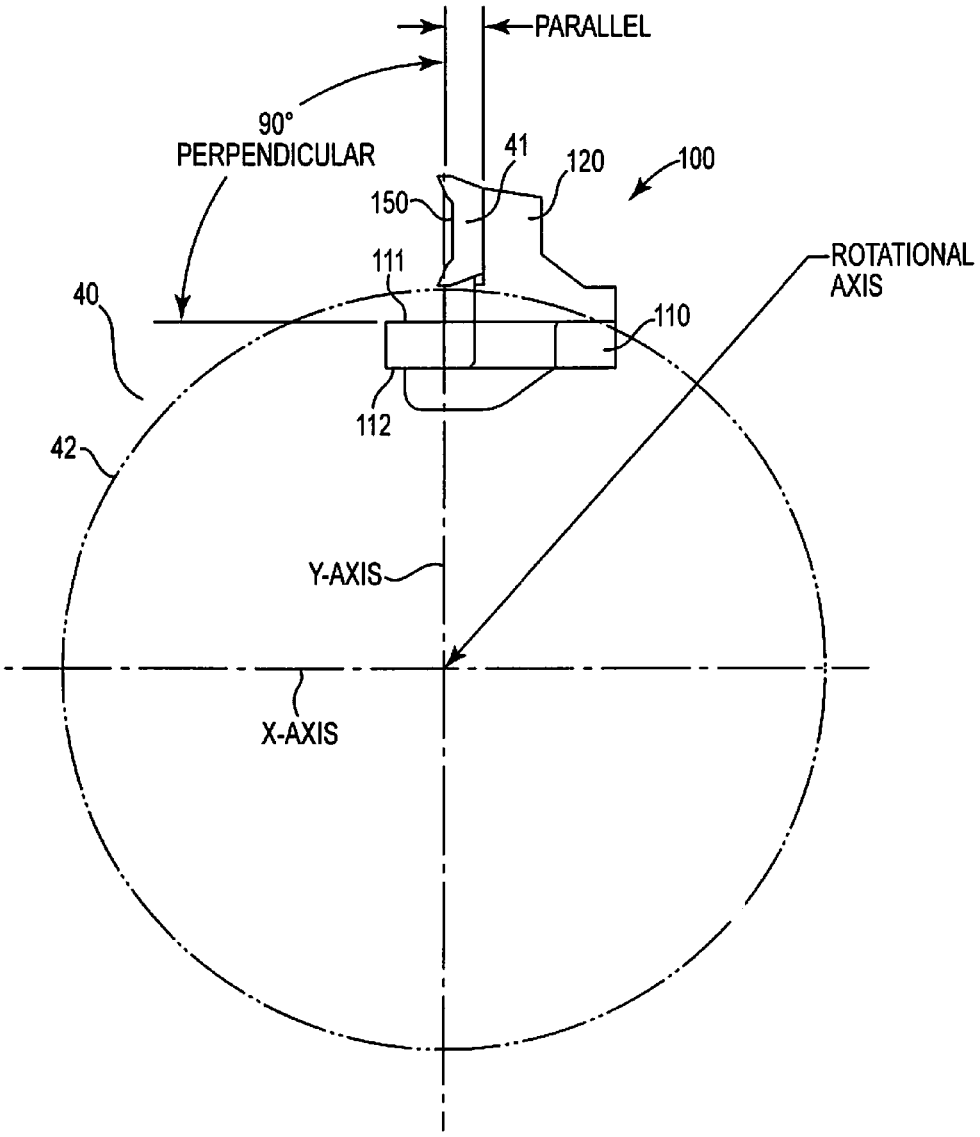
FIG. 6 is a broken away side view of one embodiment of the present invention.

The alignment of the system 100 will now be described further. Rotor 40 and cylindrical drum 42 comprise a central rotational axis as illustrated in FIG. 6, superimposed on an x,y axis grid, with rotor 40 and cylindrical drum 42 rotating in a symmetrical manner around the central rotational axis, wherein the rotational axis is the x,y axis origin. The holder 110 is arranged within cylindrical drum 42, specifically within each cutout 102, so that its upper and lower surfaces 111, 112 are substantially perpendicular with the y-axis and substantially parallel to the x-axis, wherein the rotational axis is the origin. Consequently, when the mount 120 is attached as described above to the holder 110, its leading surface 138 is substantially parallel with the y-axis and substantially perpendicular with the x-axis and with the upper and lower surfaces 111, 112 of holder 110. In turn, the attachment of the tooth 41 to the attached mount 120, results in the leading flat middle surface 150 of the tooth 41 being substantially parallel with the y-axis and with the leading surface 138 of the mount 120, and being substantially perpendicular with the x-axis and the upper and lower surfaces 111, 112 of the holder 110.

In order to maintain high-speed rotational balance, it will be clear to the skilled artisan that each system 100 of the present invention will have a counterpart system 100 located 180 degrees away on the opposite side of the cylindrical drum 42. However, there is no physical connection between the balancing pair of systems 100.

Returning now to the benefits of the attachment of mount 120 with holder 112 as described above. As the rotor 40 rotates in the direction indicated by the arrow of FIG. 3, the force of impact will be sustained by the leading surfaces of the teeth 41 and transferred through the teeth 41 to the mount 120 and the holder 110 to which the mount is attached. Thus, such forces experienced during impact will tend to pull the upper arm 124 of mount 120 downward and lower arm 122 of mount 120 upward. Each such responsive force is absorbed by the engagement of each arm 124, 122 with holder 110 as described above. The engagement of holder 110 and mount 120 results in absolute restriction of movement of the mount 120 and attached tooth 41 in the direction opposite that of the indicated rotational direction; all impact is absorbed and transferred throughout the cylindrical drum 42 when the mount 120 is engaged with holder 110. The result is absorption of these shearing and impact forces, without twisting of the mount 120 or loosening or shearing of bolts B. It is the shape of the mount 120 in relation to the holder 110 that allows such efficient absorption of impact force and minimization of impact stress.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A replaceable mount system for a fragmenting machine, the fragmenting machine having a frame, a feeding means for feeding waste materials to the machine; and at least partially enclosed fragmenting chamber, the fragmenting chamber housing a fragmenting rotor capable of rotating in a rotational direction, the fragmenting rotor comprising a cylindrical drum having an outer surface, the replaceable mount system comprising:

a plurality of spaced apart cutouts defined by the outer surface of the cylindrical drum;

a holder attached within each of the plurality of spaced apart cutout, the holder further comprises:

an upper surface, a lower surface, a leading mounting bolt aperture through the holder and a trailing mounting bolt aperture through the holder, and a central aperture through the holder disposed between the leading mounting bolt aperture and the trailing mounting bolt aperture;

a mount attached to each holder, the mount comprising:

a leading surface having a geometry, and a central body, the central body comprising a lower arm and an upper arm, the lower arm comprising an upper surface and a lower surface and an aperture therethrough, the lower arm comprising an upper surface and a lower surface and an aperture therethrough, wherein the attached mount cannot move in a direction opposite the rotational direction when the mount is attached to the holder; and a tooth, comprising a body having a back surface with a geometry that is complementary with the geometry of the leading surface of the mount, attached to each mount.

2. The replaceable mount system of claim 1, wherein the mount's central body further comprises a leading surface and a trailing surface, with an aperture therethrough.

3. The replaceable mount system of claim 2, wherein the leading surface comprises a central raised section with flat sections on each side of the central raised section and adjacent the central raised section.

4. The replaceable mount system of claim 1, wherein the lower arm of the mount engages the central aperture of the holder and the lower surface of the lower arm engages the lower surface of the holder.

5. The replaceable mount system of claim 4, wherein the lower surface of the upper arm of the mount engages the upper surface of the holder.

6. The replaceable mount system of claim 5, wherein the lower arm aperture of the mount aligns with the leading mounting bolt aperture of the holder and wherein the upper arm aperture of the mount aligns with the trailing mounting bolt aperture of the holder.

7. The replaceable mount system of claim 5, further comprising a first mounting bolt securingly engaging the aligned lower arm aperture of the mount and the leading mounting bolt aperture of the holder and a second mounting bolt securingly engaging the upper arm aperture of the mount and the trailing mounting bolt aperture of the holder.

8. The replaceable mount system of claim 7, wherein the tooth comprises a flat leading middle surface, an upper angled grinding surface adjacent the leading middle surface, and a lower angled grinding surface adjacent the leading middle surface, and an aperture through the leading middle surface, the aperture capable of alignment with the aperture through the central body's leading and trailing surfaces.

9. The replaceable mount system of claim 7, further comprising a third mounting bolt securingly engaging the aligned aperture through the tooth's leading middle surface and the aperture through the central body's leading and trailing surfaces; and a tightening nut, the nut capable of securing the mounting bolt and attaching the tooth to the mount.

10. A replaceable mount system for a fragmenting machine, the fragmenting machine having a frame, a feeding means for feeding waste materials to the machine; and at least partially enclosed fragmenting chamber, the fragmenting chamber housing a fragmenting rotor capable of rotating in a rotational direction, the fragmenting rotor comprising a cylindrical drum having an outer surface and a rotational axis, the replaceable mount system comprising:

a plurality of spaced apart cutouts defined by the outer surface of the cylindrical drum;

a holder attached within each of the plurality of spaced apart cutouts, the holder further comprising an upper surface, a lower surface and a leading mounting bolt aperture through the holder, a trailing mounting bolt aperture through the holder, and a central aperture through the holder disposed between the leading mounting bolt aperture and the trailing mounting bolt aperture;

a mount attached to each holder, the mount comprising a central body, the central body comprising a leading surface and a trailing surface, with an aperture therethrough, a lower arm and an upper arm, the lower arm comprising an upper surface and a lower surface and an aperture therethrough, the lower arm comprising an upper surface and a lower surface and an aperture therethrough, wherein the lower arm of the mount engages the central aperture of the holder and the lower surface of the lower arm engages the lower surface of the holder and wherein the lower surface of the upper arm of the mount engages the upper surface of the holder, and wherein the attached mount cannot move in a direction opposite the rotational direction when engaged with the holder; and a tooth attached to each mount.

11. The replaceable mount system of claim 10, wherein the leading surface comprises a central raised section with flat sections on each side of the central raised section and adjacent the central raised section.

12. The replaceable mount system of claim 10, wherein the lower arm aperture of the mount aligns with the leading mounting bolt aperture of the holder and wherein the upper arm aperture of the mount aligns with the trailing mounting bolt aperture of the holder.

13. The replaceable mount system of claim 12, further comprising a first mounting bolt securingly engaging the aligned lower arm aperture of the mount and the leading mounting bolt aperture of the holder and a second mounting bolt securingly engaging the upper arm aperture of the mount and the trailing mounting bolt aperture of the holder.

14. The replaceable mount system of claim 10, wherein the tooth comprises:

a flat leading middle surface;

an upper angled grinding surface adjacent the leading middle surface;

a lower angled grinding surface adjacent the leading middle surface;

an aperture through the leading middle surface, the aperture capable of alignment with the aperture through the central body's leading and trailing surfaces; and a back surface, the back surface comprising a central groove, the central groove capable of receiving the central raised section of the leading surface of the mount.

15. The replaceable mount system of claim 10, wherein the flat middle leading surface of the tooth is parallel with the leading surface of the mount.

16. The replaceable mount system of claim 15, further comprising the leading surface of the mount being perpendicular with the upper and lower surfaces of the holder.

* * * * *